US006131530A

United States Patent [19]

Burgmyer et al.

[11] Patent Number: 6,131,530

[45] Date of Patent: Oct. 17, 2000

[54] TWO MAN LOADING PLATFORM FOR USE ON SUBMARINES

[75] Inventors: Leonard E. Burgmyer, Somerset, Mass.; James C. Butts, Casco, Me.; Earl S. Nickerson, Little Compton, R.I.; William S. Wilkinson, Dartmouth, Mass.; Wayne C. Tucker, Exeter, R.I.

[73] Assignee: The United States of America as represented by the Secretary of the Navy, Washington, D.C.

[21] Appl. No.: 09/226,624

[22] Filed: Dec. 21, 1998

[51] Int. Cl.[7] ..... B63G 8/00

[52] U.S. Cl. ..... 114/313; 414/137.1; 405/218

[58] Field of Search ..... 114/313, 362; 414/137.1, 137.2, 137.7; 14/4, 69.5; 405/218, 220, 221

[56] References Cited

U.S. PATENT DOCUMENTS

| | | | |
|---|---|---|---|
| 2,687,617 | 8/1954 | Newell | 405/221 |
| 3,046,748 | 7/1962 | Monroe | 405/221 |
| 3,081,601 | 3/1963 | Fentiman | 405/221 |
| 3,841,104 | 10/1974 | Hufford | 405/218 |
| 4,398,849 | 8/1983 | Moran et al. | 405/221 |
| 4,793,275 | 12/1988 | Usher | 414/139.4 |

*Primary Examiner*—Jesus D. Sotelo
*Attorney, Agent, or Firm*—Michael J. McGowan; Robert W. Gauthier; Prithvi C. Lall

[57] ABSTRACT

A platform for servicing of vertically positioned missiles in a ballistic missile submarine. The platform includes a vertically inclined rail and a horizontal frame. In the frame there is a first element having a first and a second end superimposed over the inclined rail. This first element is movably mounted directly on the rail at the first end and movably mounted in vertically spaced relation above said inclined rail at said second end. At least one second element is spaced laterally from the first element to enclose a missile tube access opening. A vertical support means is also positioned in opposed relation to the inclined rail. The vertical support means is adjustable to the curved hull surface of the submarine to maintain the frame horizontal. The platform is constructed from a lightweight material such as aluminum, and it can be carried and assembled by two men for the efficient servicing of VLS equipped submarines and other similar vessels.

20 Claims, 2 Drawing Sheets

TWO MAN LOADING PLATFORM FOR USE ON SUBMARINES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine docks and piers and more particularly to portable or demountable marine docks and piers.

(2) Brief Description of the Prior Art

The prior art discloses various portable or demountable marine piers.

U.S. Pat. No. 2,687,617 to Newell, for example, discloses a pier structure comprising side rails and legs. The legs are connected to their respective deck frames. The respective pier sections are detachably connected to the next preceding pier section by means of detachable couplings.

U.S. Pat. No. 3,081,601 to Fentiman discloses a demountable dock for small water craft comprising an elongated frame which includes knockdown girders that are rigidly braced in spaced parallel relation by crossed arms.

U.S. Pat. No. 3,046,748 to Monroe discloses a pier in which axially spaced, link connected brackets are secured to cross-bars to enable the pier to be foldable.

U.S. Pat. No. 3,841,104 to Hufford discloses a dock structure that is easily assembled or dismantled for winter storage including foldable support posts that are readily removable from a gangplank. When disassembled the gangplank is adapted for on shore storage. The shore end of the gangplank is removably connectable to an on shore support. At its opposite end the gangplank is removably connected to and supported by posts, which are secured at their lower ends to the bottom formation of a body of water. Submerged, pivotal coupling between the upper and lower ends of the post allow the upper post portions to rotate relative to the lower portions in relative rectilinear relationship for supporting the offshore end of the gangplank when the dock is assembled.

U.S. Pat. No. 3,999,397 to Albery discloses a modular dock system comprising one or more dock panels adapted to be interconnected into a pier. Each of said panels comprises a plurality of elongated extruded aluminum panel members having a flat upper wall, a pair of side walls having flanges along the lower edges and a central rib structure having lower flanges parallel of the flanges on the side wall. A pair of aluminum cross-members at opposite ends of the panel members have a channel shaped cross-section and a web secured to the flanges of said panel members and a pair of downwardly extending side flanges.

U.S. Pat. No. 4,398,849 to Moran et al. discloses a portable dock and dock sections having a plurality of frame members forming a rectangular deck frame for supporting a deck assembly, a pair of adjustable legs extending from adjacent one end of the rectangular deck frame and a first coupling unit disposed on a frame member at the other end of the deck frame.

U.S. Pat. No. 4,604,001 to Wetmore discloses a jackdown tension leg platform which may be used for processing a commodity liberated from the ocean floor by one or more wells. The platform includes a closed buoyant hull which houses production equipment and at least one connector disposed on the one end secured to the ocean floor which is moved upwardly relative to the hull to submerge the hull to a depth below the majority of the ocean's hydrostatic forces and, at the same time, tension the connector to hold and stabilize the hull over the wells. Conduits are connected between the wells and the submerged hull and between the hull and the surface.

Ballistic missile submarines are conventionally characterized by a Vertical Launch System (VLS) having a plurality of missile tubes. Such a system is usually serviced by a large structure that partially surrounds the submarine at its bow and on both lateral sides. Such a large steel structure conventionally requires a dockside crane and several men for a day to assemble.

In the case where only one or two tubes need a platform, or if a crane is not available, there is a need for a lightweight platform that could be carried and assembled by two men and stored on the submarine to allow for faster and better serviceability for the VLS.

SUMMARY OF THE INVENTION

It is an object of the present invention to provide a two man loading platform for VLS equipped submarines and other similar vessels.

The present invention comprises a platform for placement of vertically positioned missiles in a ballistic missile submarine, such as a SSN 688 class submarine equipped with VLS missile tubes. The platform includes a vertically inclined rail and a horizontal frame. In the frame there is a first element having a first and a second end superimposed over the inclined rail. This first element is movably mounted directly on the rail at the first end and movably mounted in vertically spaced relation above said inclined rail at said second end. At least one second element is spaced laterally from the first element to enclose a missile tube access opening. A vertical support means is also positioned in opposed relation to the inclined rail.

The invention also encompasses a submersible vessel comprising a hull having an upper surface having a longitudinal centerline and opposed lateral convex surfaces. A longitudinal rail is superimposed on the upper surface of the hull approximately over at least part of its centerline. A horizontal frame comprising a first element is superimposed over the rail and a second element extends laterally from the first element. A frame support means is vertically interposed between one of the convex lateral surfaces and the second element of the horizontal frame.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DESCRIPTION OF THE PREFERRED EMBODIMENT

Figure 1:
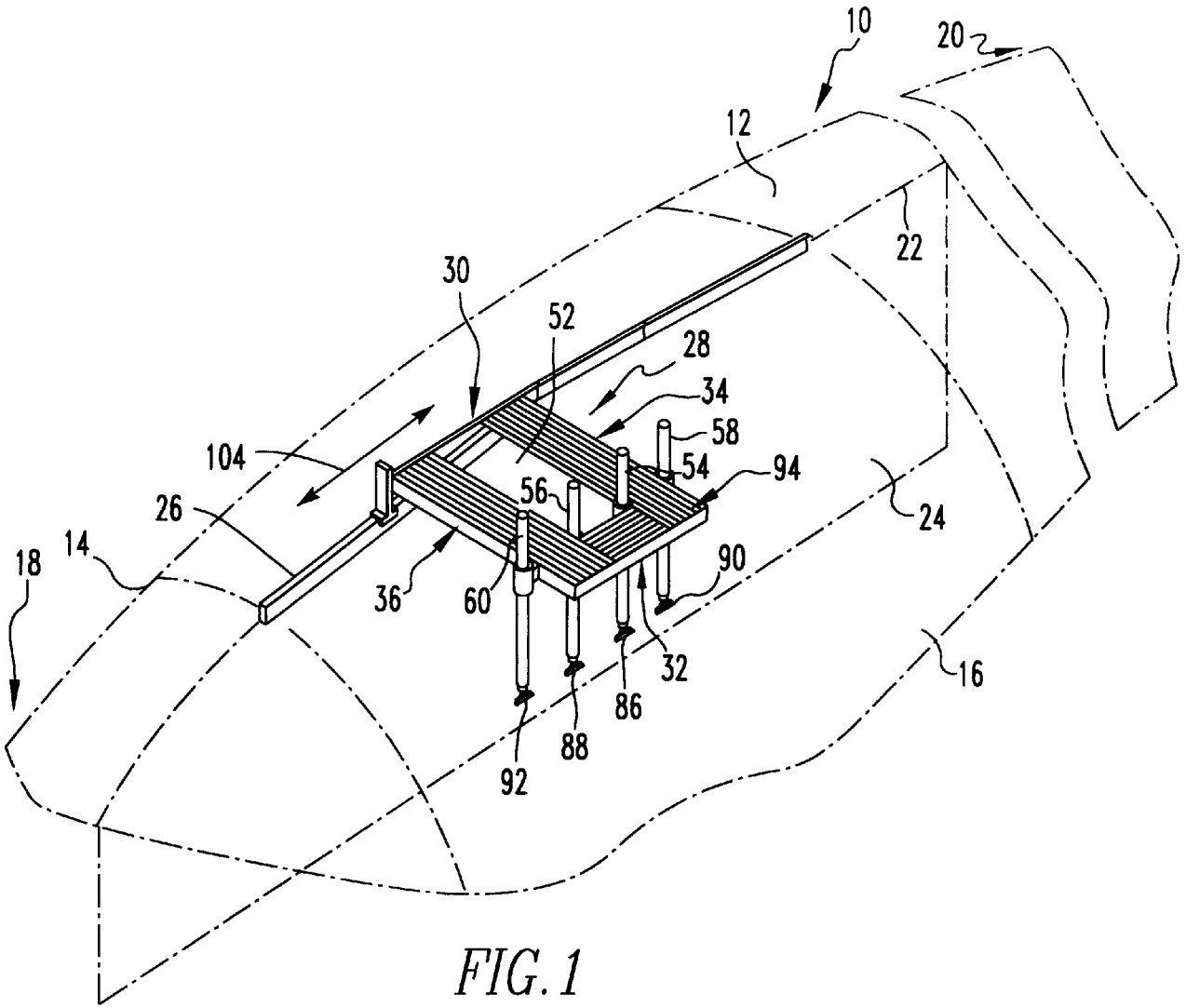
FIG. 1 is a perspective view of a preferred embodiment of the platform of the present invention shown as mounted on a submarine.
Figure 2:
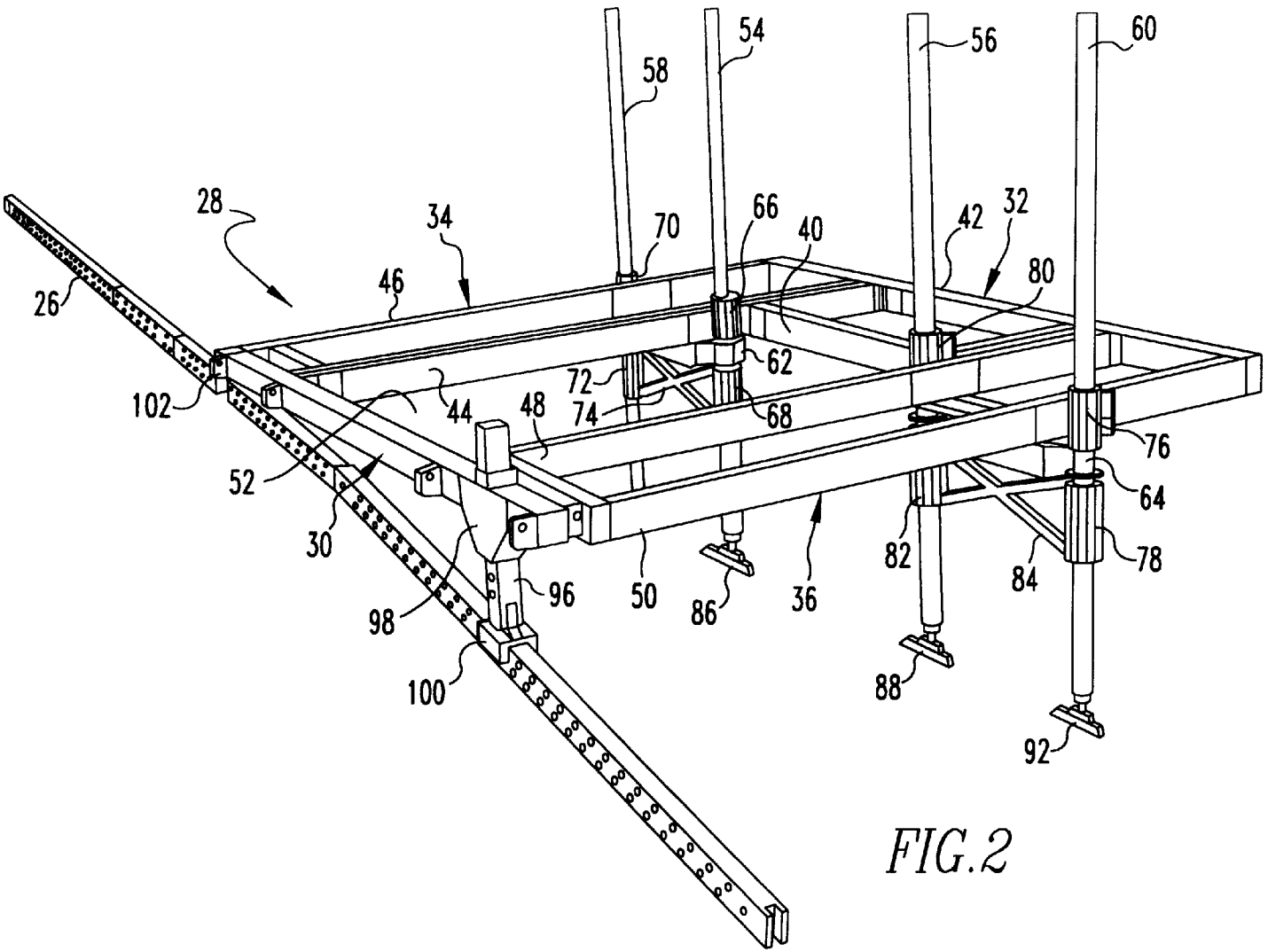
FIG. 2 is a more detailed inner front perspective view of the platform shown in FIG. 1.

Referring to FIG. 1, the submarine hull 10 (shown as fragment) has an upper side 12 and opposed concave lateral sides 14 and 16. The upper side 12 slopes downwardly in the direction of the bow 18 and also slopes downwardly in the direction of the stern 20. The upper side 12 has a centerline 22 that coincides with a center plane of the entire vessel. This submarine may preferably be a 688 Class submarine, usually referred to as SSN 688 Class submarine, equipped with VLS missile tubes, or other similar vessel. Referring now also to FIG. 2, there is shown mounted on the centerline 22 of the upper side of the submarine hull 10 an inclined rail 26. The frame 28 is mounted on rail 26. The frame includes the first element 30, which is superimposed directly over the rail 26. The frame also includes the second element 32 that is in spaced parallel relation to the first element 30. Spaced transverse third element 34 and fourth element 36 connect the first element 30 and second element 32 in perpendicular relation. The second element 32 includes an inner beam 40 and an outer beam 42. The third element 34 includes an inner beam 44 and an outer beam 46. The fourth element 36 includes an inner beam 48 and an outer beam 50. Between the first element 30 and the inner beams 40, 44, and 48 there is defined a missile tube access space 52. At the intersection of the inner beam 40 and the inner beam 44 there is a first outer vertical support 54. At the intersection of the inner beam 40 and the inner beam 48 there is a second outer vertical support 56. Along the outer element 46 there is a third vertical support 58. Along the outer element 50 there is a fourth outer vertical support 60. The first vertical support 54 is attached to beam 44 by means of a flange 62, which allows vertical movement of the beam 44 along the vertical support 54. Similarly, the fourth vertical support 60 is attached to beam 50 by means of a flange 64. The third vertical support 58 is similarly fixed to beam 46 by another flange (not shown), and second vertical support 56 is attached to beam 48 by another flange (not shown). Flange 62 is interposed between an upper lock 66 and a lower lock 68. Vertical support 58 has a similar upper lock 70 and a lower lock 72, and lower lock 72 is connected to lower lock 68 by a lower transverse frame 74. Above flange 64 there is an upper lock 76 and below flange 64 there is a lower lock 78. Vertical support 56 has an upper lock 80 and a lower lock 82 that is connected to the lower lock 78 by a lower transverse frame 84. Each of the vertical supports 54, 56, 58 and 60 has a foot, respectively 86, 88, 90 (FIG. 1) and 92. Interposed between the inner beams and the outer beams of the second element 32, third element 34 and the fourth element 36, there is a grate 94 (FIG. 1). On the first element 30 there is a forward inner vertical support 96 that passes through a support receiving structure 98 and which has a rail engagement foot 100. On its aft end, the first element 30 also has an aft rail engagement foot 102.

The vertical position of the platform frame 28 is adjustable on the vertical supports 54, 56, 58, 60 and 96, and the frame would preferably be leveled prior to use. The frame 28 could also be locked on rail 26 at its feet 100 and 102. These locks could be disengaged to allow the frame to be moved fore and aft on the rail in the directions of the arrows 104 shown in FIG. 1.

The platform is capable of being carried and assembled by two men on the deck of a 688 Class submarine or similar vessel. The new platform eliminates the need to assemble the complete loading platform requiring a dockside crane and several workers. The lightweight platform would be used on a single missile tube at one time, but be capable of servicing any one of the twelve tubes.

The new platform is preferably constructed from lightweight aluminum and breaks down into component parts that can be carried and assembled by two men without the use of a dockside crane. The rail is designed to conform to the curvature of the submarine hull and to use existing fittings on the deck as attachment points. If a crane were available, the assembled platform could be moved from tube to tube if numerous tubes were to be serviced and the full sized platform was not available. The lightweight platform can be set up and taken down in a relatively short period of time and can be rigged for stowage on a submarine allowing missile tube access in remote areas.

It will, therefore, be appreciated that a lightweight platform has been described, which can be carried and assembled by two men and that can be used to allow for the efficient servicing of VLS equipped submarines and other similar vessels.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A platform for use in servicing vertically positioned missiles in a submarine comprising:

a vertically inclined rail;

a horizontal frame comprising a first element having a first and a second end superimposed over the inclined rail and movably mounted directly on the rail at the first end and movably mounted in vertically spaced relation above said inclined rail at said second end, the frame having at least one second element spaced laterally from the first element to enclose a missile tube access opening; and vertical support means positioned in opposed relation to the inclined rail.

2. The platform of claim 1 wherein the at least one second element of the horizontal frame is in parallel relation to the first element.

3. The platform of claim 2 wherein the horizontal frame includes a third and a fourth spaced parallel elements transverse to and connected between the first and second elements.

4. The platform of claim 1 wherein the rail is positioned on the upper hull surface of the submarine.

5. The platform of claim 4 wherein the inclined rail is approximately positioned on a vertical centerline of the submarine.

6. The platform of claim 5 wherein the vertical support means bears against one of at least one opposed lateral convex surfaces of the submarine.

7. The platform of claim 3 wherein the second, third and fourth elements comprise horizontal walkways.

8. The platform of claim 7 wherein the walkway has an inner periphery forming a first inner intersection between the second and the third elements and a second inner intersection between the second and fourth elements, the platform further comprising:

first and second inner vertical supports respectively positioned at said first and second intersections; and first and second outer vertical supports respectively positioned adjacent the third and fourth elements in opposed relation respectively to the first and second inner vertical supports.

9. The platform of claim 6 wherein the vertical support means is vertically adjustable to conform to the convex lateral surfaces of the submarine.

10. The platform of claim 9 wherein the submarine centerline has a curve, the vertical support means being adjustable to conform to the curve of the centerline.

11. The platform of claim 8 wherein a first transverse frame connects the first inner vertical support with the first outer vertical support and a second transverse frame connects the second inner vertical support and the second outer vertical support.

12. A servicing platform for a submersible vessel having an upper surface with a longitudinal centerline and opposed lateral convex surfaces, the platform comprising:

a longitudinal rail superimposed on the upper surface over approximately at least part of said longitudinal centerline, the rail following a curved contour of the centerline;

a horizontal frame comprising a first element superimposed over the rail and a second element spaced laterally from the first element; and a frame support means vertically interposed between one of the concave lateral surfaces and the second element of the horizontal frame.

13. The platform of claim 12 wherein the first element of the frame has a first and a second end and the first end is movably mounted in vertically spaced relation above the rail.

14. The platform of claim 12 wherein the second element of the horizontal frame is in parallel opposed relation to the first element.

15. The platform of claim 12 wherein the horizontal frame includes a third and a fourth spaced parallel elements transverse to and connected between the first and second elements.

16. The platform of claim 15 wherein the second, third and fourth element comprise horizontal walkways.

17. The platform of claim 16 wherein the walkway has an inner periphery forming a first inner intersection between the second and the third elements and a second inner intersection between the second and fourth elements, the frame support means further comprising:

first and second inner vertical supports respectively positioned at said first and second intersections; and first and second outer vertical supports respectively positioned adjacent the third and fourth elements in opposed relation respectively to the first and second inner vertical supports.

18. The platform of claim 17 wherein the frame support means is vertically adjustable to conform to the convex lateral surfaces.

19. The platform of claim 18 further comprising a second vertical support between the rail and the second end of the first element of the frame, said second vertical support being adjustable to conform to the curved contour of the centerline.

20. The platform of claim 17 wherein a first transverse frame connects the first inner vertical support with the first outer vertical support and a second transverse frame connects the second inner vertical support and the second outer vertical support.

* * * * *